US005996986A

United States Patent [19]

Ewing

[11] Patent Number: 5,996,986

[45] Date of Patent: Dec. 7, 1999

[54] VISE STOP

[76] Inventor: Harold E. Ewing, 226 Chestnut St., Pleasantville, Pa. 16341

[21] Appl. No.: 09/249,996

[22] Filed: Feb. 16, 1999

[51] Int. Cl.[6] ..... B25B 1/24

[52] U.S. Cl. ..... 269/282; 269/315

[58] Field of Search ..... 269/282, 304, 269/315

[56] References Cited

U.S. PATENT DOCUMENTS

| | | | |
|---|---|---|---|
| 3,810,311 | 5/1974 | Pingel | 269/315 |
| 3,827,686 | 8/1974 | Storkh | 269/315 |
| 4,030,718 | 6/1977 | Philipoff | 269/315 |
| 5,018,562 | 5/1991 | Adams | 269/315 |
| 5,197,721 | 3/1993 | Ruberg | 269/315 |
| 5,895,184 | 4/1999 | Walters et al. | 269/315 |

*Primary Examiner*—Timothy V. Eley
*Assistant Examiner*—Benjamin M. Halpern
*Attorney, Agent, or Firm*—Warren F. B. Lindsley; Frank J. McGue

[57] ABSTRACT

A vise stop that enables an operator to precisely position like parts in a vise for the purpose of successively applying the same machining operation on each of a number of such like parts.

4 Claims, 3 Drawing Sheets

VISE STOP

BACKGROUND OF THE INVENTION

Machining operations often comprise the production of a number of identical parts, each of which involves cutting, drilling, milling or other machining operations at precise locations on the part or work piece. A major part of the time consumed in such operations involves the initial set-up, i.e. the positioning of the vise and the positioning of the part in the vise jaws relative to the cutting blade, drill bit or other machine tool being used. For repetition of the same operation on successive parts, the position of the vise can not be disturbed between machining of the various parts, but unless some means is provided for quickly and precisely positioning each successive part at the same location in the vise jaws, the time spent on this machining process can be considerable. The present invention concerns an attachment for a vise in the form of an adjustable vise stop which serves as a convenient and precise means for positioning successive work pieces at the same location in the vise jaws.

DESCRIPTION OF THE PRIOR ART

No pertinent prior art on this subject matter is known.

SUMMARY OF THE INVENTION

In accordance with the invention claimed, a versatile and convenient vise stop is provided for attachment to the fixed jaw of a vise. The vise stop precisely defines the location of the work piece in the jaws of the vise so that like parts that are to be successively machined may be quickly and correctly positioned in the vise for repetitive machining operations.

It is, therefore, one object of this invention to provide a vise stop that will enable an operator to properly position like parts in a vise for the purpose of successively applying the same machining operations to each of a number of like parts.

Another object of this invention is to provide such a vise stop in a form that may be readily attached to a jaw of a vise of the type commonly employed by machinists for mounting a work piece on the table of a machine tool.

A further object of this invention is to provide such a vise stop in a form which may be easily and quickly set to any desired position to the left or the right of the work piece.

A still further object of this invention is to provide such a vise stop in a form which permits the stop to be moved vertically and horizontally over a considerable range in order to accommodate work pieces of different dimensions.

A still further object of this invention is to provide such a vise stop in a form which permits the stop and its support mechanism to be located in its entirety below the top surface of the vise so as not to interfere with the machining operations.

A still further object of this invention is to provide such a vise stop which permits the vise stop support mechanism to be positioned behind the fixed jaw of the vise.

A still further object of this invention is to provide such a vise stop in a form which permits a part of its support mechanism to serve as a jaw face mounted behind the fixed jaw of the vise where it permits the vise as well as the stop to accommodate work pieces with dimensions exceeding the maximum opening of the vise jaws.

Yet another object of this invention is to provide such a vise stop in a form which may remain attached to the jaw of the vise during other machining operations not requiring its use, the stop and its support mechanism being pivoted out of the way for storing purposes.

BRIEF DESCRIPTION OF THE DRAWINGS

The present invention may be more readily described by reference to the accompanying drawings, in which.

DESCRIPTION OF THE PREFERRED EMBODIMENT

Figure 1:
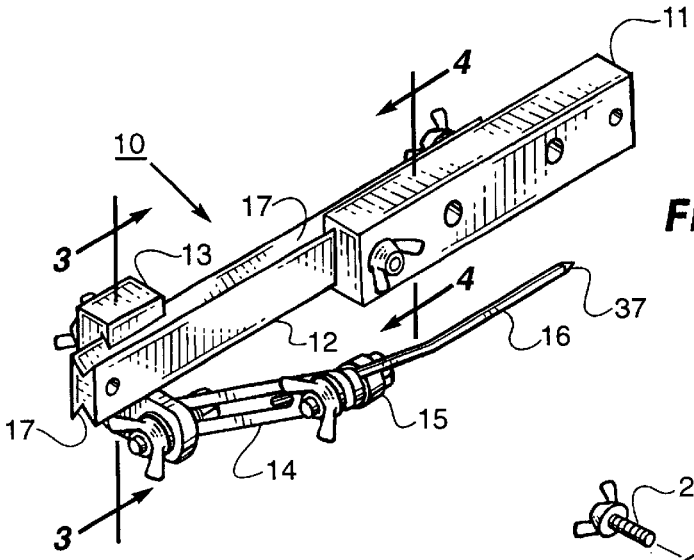
FIG. 1 is a perspective view of a vise stop embodying the invention.

Referring more particularly to the drawings by characters of reference, FIGS. 1–4 disclose a vise stop 10 embodying the invention. As shown, the vise stop 10 comprises a modified jaw face 11, a movable rail 12, a pointer shuttle 13, a pointer support arm 14, a pointer holder 15, and a pointer 16 all of which are preferably made of metal such as steel or aluminum.

Figure 2:
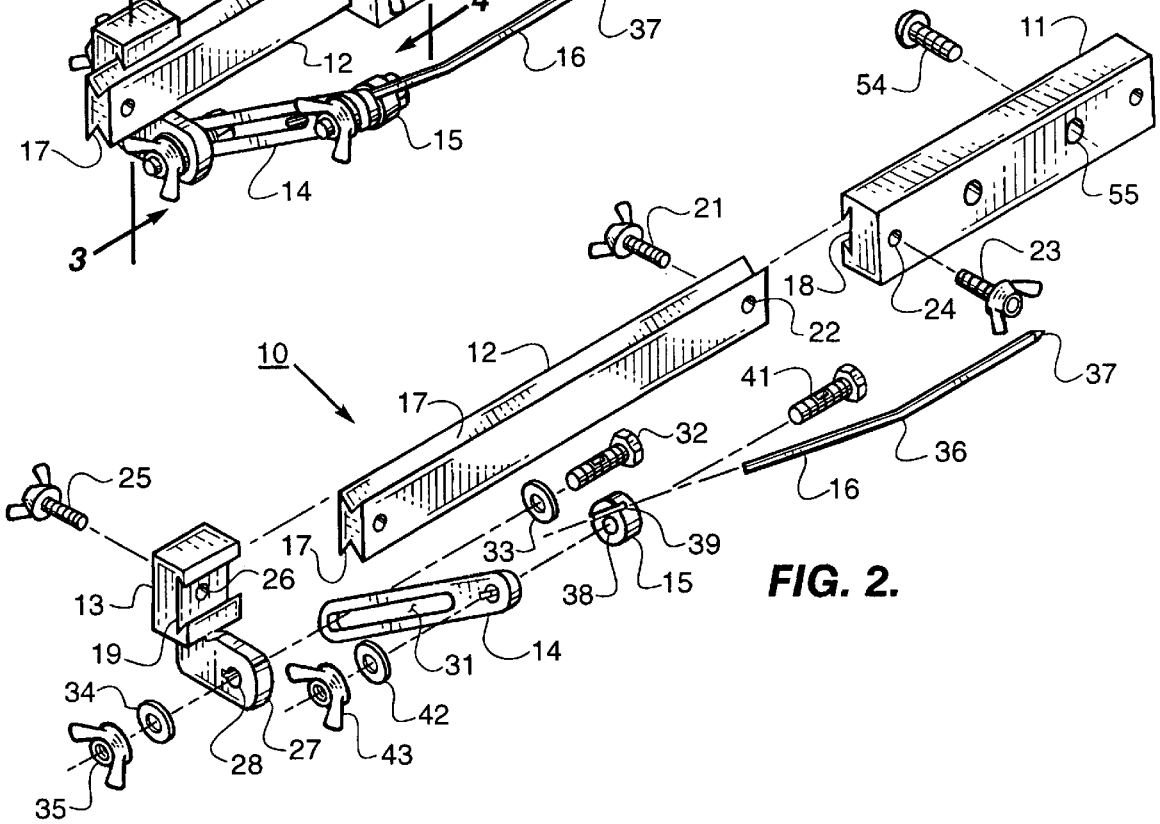
FIG. 2 is an exploded view of the vise stop of FIG. 1.
Figure 3:
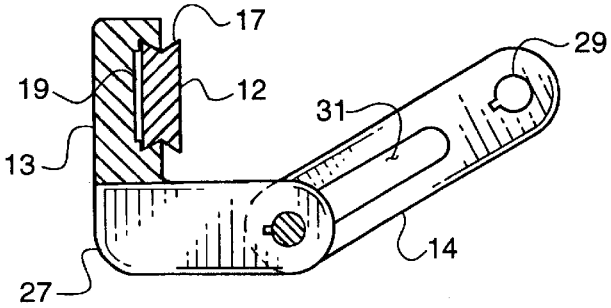
FIG. 3 is a cross-sectional view of FIG. 1 taken along line 3—3.
Figure 4:
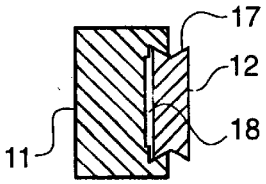
FIG. 4 is a cross-sectional view of FIG. 1 taken along line 4—4.

As shown in FIGS. 1–4, rail 12 has longitudinal troughs 17 cut into its top and bottom edges. The sides of each of the troughs 17 slope inwardly from their outer edges to a centered line of intersection. As shown in FIGS. 2 and 4, the forward half of rail 12 mates in sliding dovetail fashion with a complementary longitudinal slot 18 of modified jaw face 11, and as shown in FIGS. 1, 2 and 3, the rearward half of rail 12 mates in sliding dovetail fashion with a complementary slot 19 of shuttle 13. By virtue of these configurations, rail 12 is seen to be secured in longitudinally slidable fashion to modified jaw face 11, while shuttle 13 is carried by rail 12 and may be moved along the length of rail 12 to any desired position thereon.

The longitudinal position of rail 12 along modified jaw face 11 may be secured by a clamping screw 21 which screws into a threaded hole 22 at one or the other end of rail 12 and impinges upon the base of slot 18 of modified jaw face 11. Additionally, the position may be secured by a clamping screw or screws 23 which screw into threaded holes 24 at the ends of modified jaw face 11 impinging upon the forward face of rail 12.

The position of shuttle 13 upon rail 12 may be secured by means of a clamping screw 25 which screws into a threaded hole 26 of shuttle 13 and impinges upon the rearward face of rail 12.

For convenience, the clamping screws 21, 23 and 25 are identical with wing type heads or knobs to permit installation and tightening without the use of a tool.

Shuttle 13 has an attachment tab 27 that extends forwardly in a vertical plane. A keyed hole 28 near the forward end of tab 27 serves as an attachment point for pointer support arm 14.

Support arm 14 comprises a metal arm with a keyed mounting hole 29 at one end and a centered slot 31 occupying the remainder of its length. Arm 14 is slidably and pivotally mounted to tab 27 of shuttle 13 by passing a screw 32 through a first washer 33, through slot 31 of arm 14, through keyed hole 28 of tab 27 and through a second washer 34. A wing nut or knob 35 is then installed over the end of screws 32. A woodruff key engages keyed hole 28 and screw 32, thereby preventing screw 32 from turning while nut 35 is installed. Screw 32 is slotted to receive a woodruff key which engages hole 28.

Pointer 16 comprises a length of metal bar stock with a square cross-section. The bar is bent at or near its center 36 to an angle of ninety degrees. One end is preferably ground to form a point 37 which is to serve as a precise position locator.

Pointer holder 15 comprises a short metal cylinder with an axial hole 38 and with a slot 39 cut into its base along a chord of the circular base. Slot 39 has a rectangular cross-section with a width that just receives the width of pointer 16 but with a depth that is not quite adequate to completely contain the cross-section of the pointer so that when the pointer and the holder are clamped together the pointer is secured.

The mounting of pointer 16 and holder 15 proceeds as follows: A mounting screw 41 is first passed through hole 38 of holder 15, then through keyed hole 29 of arm 14 and through a washer 42. A wing nut or knob 43 is then installed over the end of screw 41. A woodruff key again prevents screw 41 from turning as wing nut or knob 43 is installed. Before tightening nut 43, the non-pointed end of pointer 16 is passed into slot 39 of holder 15. With the wing nut untightened, a number of adjustments may be made. First, the pivotal mounting of arm 14 to tab 27 may be set to any location along the length of slot 31. Secondly, the holder 15 and pointer 16 may be rotated about screw 41. Thirdly, the pointer 16 is movable inwardly and outwardly within slot 39. Fourthly, the position of the shuttle 13 along rail 12 may be adjusted, and fifthly, the angular rotation of arm 14 may be adjusted. When these adjustments have been completed and with the point 37 precisely located all the clamping screws and wing nuts associated with these adjustments are tightened to secure the pointer position.

Figure 5:
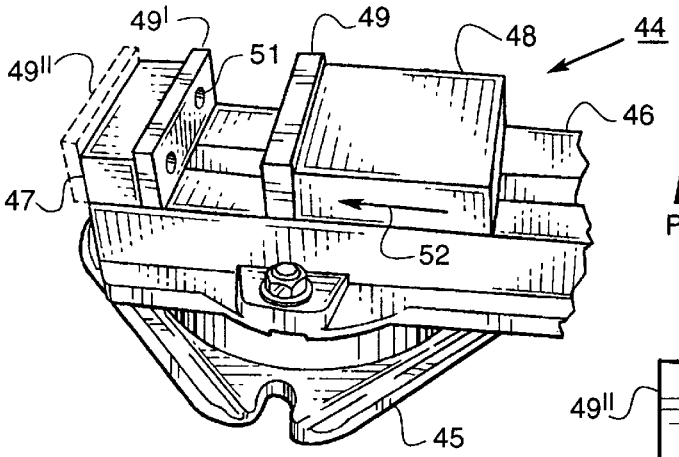
FIG. 5. PRIOR ART
FIG. 5 is a perspective view of a typical machinist's vise of the type on which the vise stop of the invention is intended to be mounted.

The vise stop 10 of the invention is intended to be used with a machinist's vise of the type shown in FIG. 5. The vise 44 of FIG. 5 comprises a base 45, a frame 46, a stationery or fixed jaw 47 and a movable jaw 48. The base 45 is typically bolted to the work table of the machine tool at an appropriate location, the frame 46 is rotated relative to the base to the desired orientation and then locked in position. Face plates 49 and 49' as appropriate for the job at hand are secured to the working surfaces of the jaws 47 and 48. The face plates are attached by means of screws passing through counter-sunk openings 51 into aligned threaded holes in the vise jaws. The part or work piece is placed between the jaws and clamped into position by means of a crank (not shown) which drives the movable jaw 48 in the direction indicated by the arrow 52.

Figure 5A:
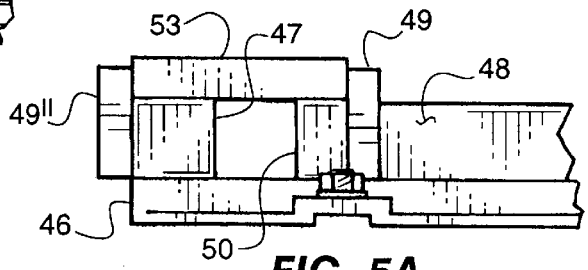
FIG. 5A. PRIOR ART
FIG. 5A is a partial side view of FIG. 5.

To accommodate a work piece with a clamped dimension exceeding the separation of the open jaws the fixed jaw face plate 45' may be moved to the outside position indicated by the broken line representation, 49". The work piece is then clamped between the inside surfaces of face plates 49 and 49" as shown in the side view of FIG. 5A where the work piece 53 is clamped between jaw face plates 49 and 49" with the aid of a support block 50 adjacent the face plate 49 of the movable jaw 48.

Figure 6:
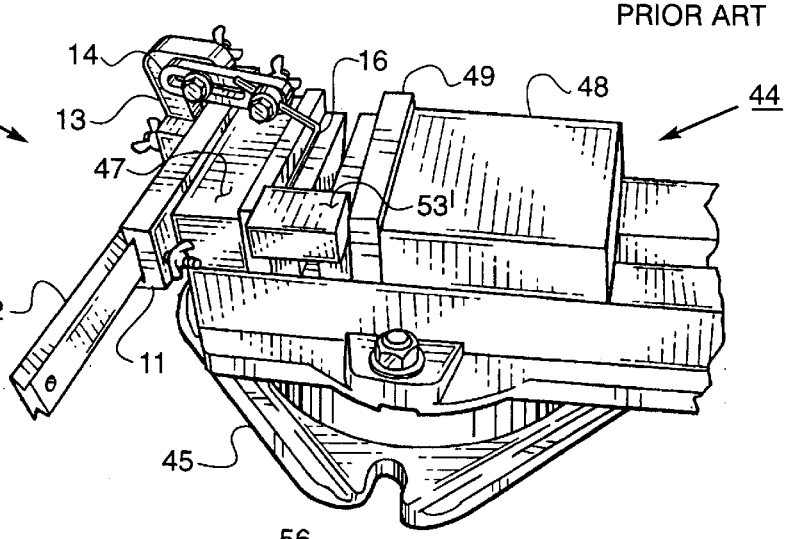
FIG. 6 is a perspective view showing the vise stop of the invention mounted upon a machinist's vise and serving as a right-hand stop for a small work piece.

FIG. 6 shows a small part or work piece 53 clamped into the vise 44 with the vise stop 10 attached to the fixed jaw 47 of the vise. The attachment of the vise stop is made by means of screws 54 which pass through countersunk holes 55 in modified jaw face 11 as shown in FIG. 2 and screw into the forward portions of the same threaded holes that are employed for the attachment of the face plate 49" to the inside surface of the stationary jaw 47 as shown in FIG. 5.

Figure 7:
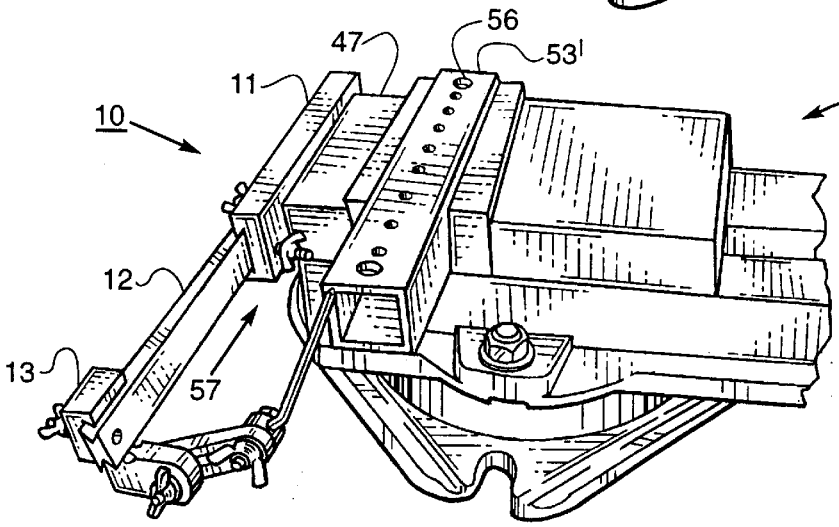
FIG. 7 is a perspective view showing the vise stop of the invention mounted upon a machinist's vise and adjusted to serve as a left-hand stop with the part or work-piece extending considerably from the left side of the vise.

It will be noted that in the example of FIG. 7, the vise stop is able to accommodate a long work piece that extends beyond the near side of the vise jaws and could just as readily accommodate a work piece that was set back inboard of the near side of the vise jaws. In this case, the operator would simply move the shuttle 13 in the direction of arrow 57.

To accommodate a work piece 53' that extends beyond the edge of the vise jaws as shown in FIG. 7, the rail 12 is moved forward and the shuttle 13 is moved to a forward position on the rail.

It will also be noted that in the application of FIG. 7, no part of the vise stop extends beyond the working surface of the part being machined. This allows maximum clearance for machine tools.

The utility of the vise stop of the invention is realized when the same machining operation is to be performed on a number of identical parts or work pieces. By way of example, assume that the hole 56 at the near end of the work Piece 53 of FIG. 7 has just been drilled and that the work piece is still in the same position relative to the drill. The machinist has only to unclamp the vise, remove the work piece that has been drilled and replace it with the next part. As the next part is installed, its forward edge is positioned against the pointer of the vise stop and clamped in place, now precisely located for the drilling operation. One time consuming alignment of the vise and the vise stop applied to the initial work piece thus suffices for the entire set of identical parts.

Figure 8:
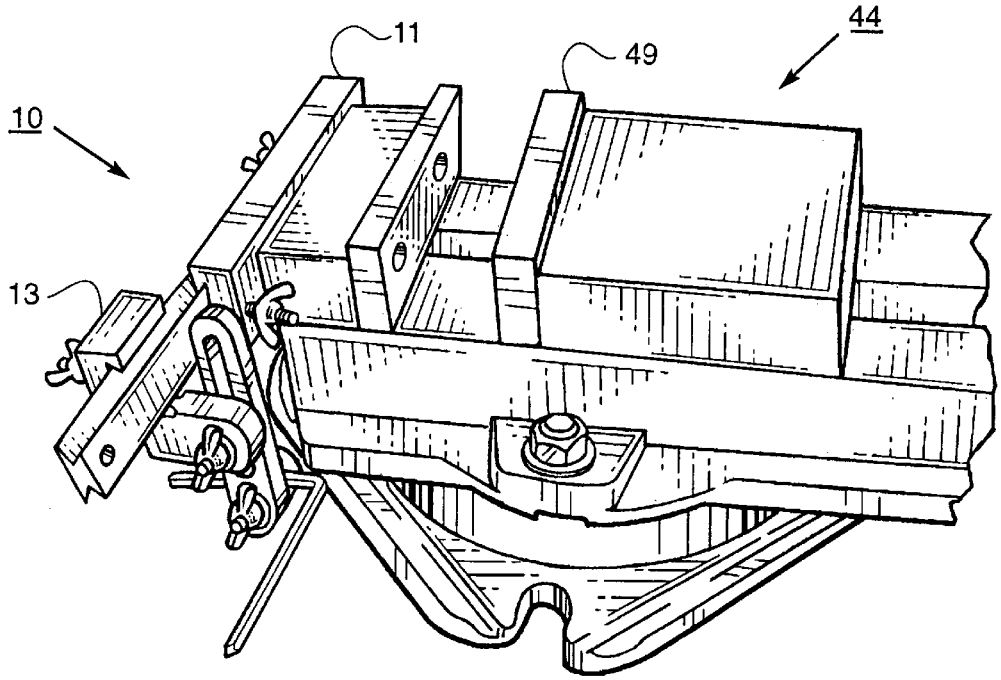
FIG. 8 is a Perspective view showing the vise stop of the invention mounted upon a machinist's vise and adjusted to an out-of-the-way storage position.

When the vise stop is not in use, it can remain attached to the vise jaw as shown in FIG. 8 without interfering with machining operations on parts that are clamped in the vise 44. Again, the various parts of the vise stop are readily adjustable to positions that do not extend beyond the working surface of the part being machined.

As shown by FIGS. 6 and 7 the stop 10 is readily arranged as a right-hand stop or as a left-hand stop using the same set of components.

Figure 9:
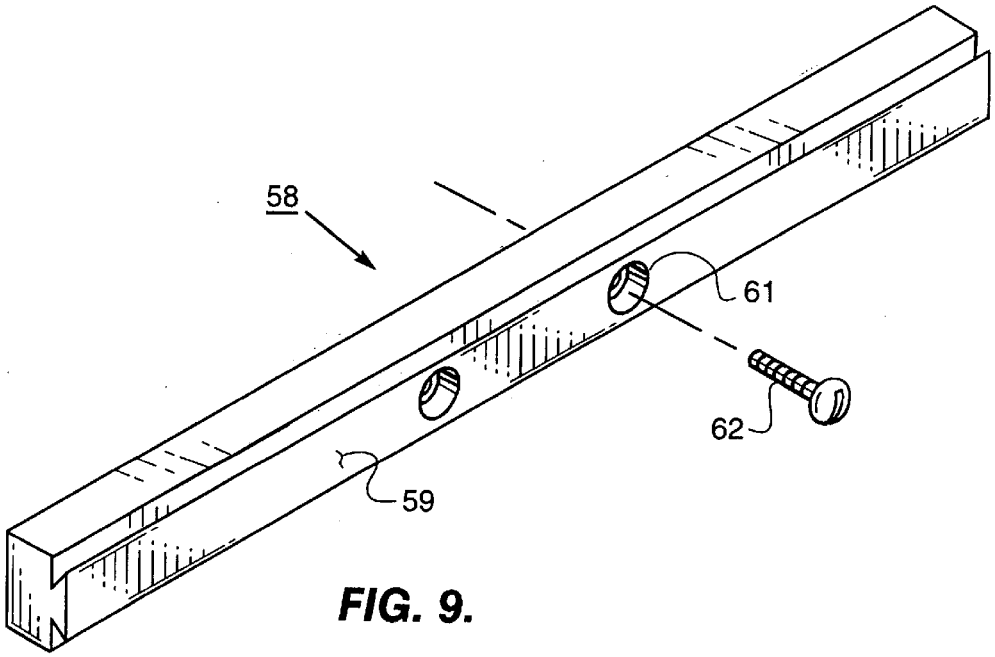
FIG. 9 is a perspective view of a combination rail and modified jaw face that may be employed in a second embodiment of the invention.

In a second embodiment of the invention, the modified jaw face 11 and the movable rail 12 are replaced by a combination jaw face and rail 58 as shown in FIG. 9. The combination jaw face and rail 58 is attached directly to the rear surface of the fixed jaw of the vise. It has one side cut to form a dove tail configuration 59 that mates with that of the shuttle 13.

The combination jaw face and rail 58 has two countersunk holes 61 at its center so that it may be attached by means of screws 62 which thread into the same two aligned holes in the stationary jaw 47 that were engaged by the screws 54 that secure the modified jaw face 11 to jaw 47 in the first embodiment of the invention.

The combination face and rail 58 when attached as just described, extends substantially from both sides of jaw 47 so that shuttle 13 when mounted on member 58 may have a range of movement equivalent to that obtained in the first embodiment with the aid of the movable rail 12.

Another important feature of the vise stop of the invention is worthy of note. As shown in FIGS. 6 and 7, the modified jaw face 11 projects above the top surface of the fixed jaw 47 of the vise. The modified jaw face thus serves in the same manner as the jaw face 49" of FIGS. 5 and 5A as a clamping means for large work pieces that do not fit inside the maximum opening of the vise jaws. This same functionality is provided by the second embodiment of the invention with its combination jaw face 58 of FIG. 9.

Although but two embodiments of the invention have been illustrated and described, it will be apparent to those skilled in the art that various changes and modifications may be made therein without departing from the spirit of the invention or form the scope of the appended claims.

What is claimed is:

1. A vise stop for precisely positioning a succession of like parts in a machinist's vise, the machinist's vise comprising a fixed or stationary jaw having an outside face, in order to perform the same machining operation on each part, said vise stop comprising:

a modified jaw face horizontally secured to the outside face of the fixed or stationary jaw of a machinist's vise in parallel orientation therewith;

a rail slidably mounted on the outside surface of said modified jaw face in parallel orientation therewith said rail adjustable to an adjusted position;

a pointer shuttle slidably mounted on said movable rail for movement therealong;

a slotted pointer support arm pivotally and slidably attached through said slot to said pointer shuttle;

a pointer holder pivotally attached through a hole at one end of said slotted pointer support arm;

a pointer slidably attached to said pointer holder; and means for locking the adjusted position of said movable rail, said pointer shuttle, said pointer support arm, said pointer holder and said pointer;

whereby when an initial work piece has been positioned in said machinist's vise at a precisely determined location, the position of said pointer may be adjusted to a position in which it impinges upon the edge of successive work pieces.

2. The vise stop set forth in claim 1 wherein:

said rail is slidably mounted in a dove tailed arrangement to an outside surface of said modified jaw face.

3. The vise stop set forth in claim 1 wherein:

said modified jaw face when secured in position behind said fixed jaw of said vise serves also as a means for accommodating a work piece having dimensions exceeding the maximum separation of the open jaws of the vise, such accommodation comprising the dual capabilities of clamping said work piece in place and serving in the capacity of the vise stop.

4. A vise stop for precisely positioning a succession of like parts in a machinist's vise, the machinist's vise comprising a fixed or stationary jaw having an outside face, in order to perform the same machining operation on each part, said vise stop comprising:

a combination jaw face and rail horizontally secured to the outside face of the fixed jaw of a machinist's vise in parallel orientation therewith;

a pointer shuttle slidably mounted upon said combination jaw face and rail for movement therealong;

a slotted pointer support arm slidably and pivotally attached at one end to said pointer shuttle;

a pointer holder rotatably mounted at one end of said slotted support arm;

a pointer slidably and rotatably attached to said pointer holder; and means for locking the positions of said pointer shuttle, said pointer support arm, said pointer holder and said pointer;

whereby when an initial work piece has been positioned in said machinist's vise at a precisely determined location the position of said pointer is readily adjustable to a position in which it impinges upon the edge of said work piece, said adjustability being realized by virtue of said slidable mounting of said pointer shuttle upon said combination jaw face and rail, said rotatable and slidable attachment of said slotted pointer support arm to said pointer shuttle, said rotatable attachment of said pointer holder to said slotted support arm and said slidable attachment of said pointer to said pointer holder.

* * * * *